US011177545B2

(12) United States Patent
Avakian

(10) Patent No.: US 11,177,545 B2
(45) Date of Patent: Nov. 16, 2021

(54) FULL BAND ORTHOMODE TRANSDUCERS

(71) Applicant: SIERRA NEVADA CORPORATION, Sparks, NV (US)

(72) Inventor: Aramais Avakian, Lake Forest, CA (US)

(73) Assignee: Sierra Nevada Corporation, Sparks, NV (US)

( * ) Notice: Subject to any disclaimer, the term of this patent is extended or adjusted under 35 U.S.C. 154(b) by 0 days.

(21) Appl. No.: 16/542,906

(22) Filed: Aug. 16, 2019

(65) Prior Publication Data

US 2021/0050641 A1 Feb. 18, 2021

(51) Int. Cl.

| | |
|---|---|
| ***H01P 1/161*** | (2006.01) |
| ***H01P 5/12*** | (2006.01) |
| ***H01P 1/165*** | (2006.01) |

(52) U.S. Cl.

CPC ..... *H01P 1/161* (2013.01); *H01P 1/165* (2013.01); *H01P 5/12* (2013.01)

(58) Field of Classification Search

CPC ..... H01P 1/161; H01P 1/165; H01P 5/12
USPC ..... 333/114
See application file for complete search history.

(56) References Cited

U.S. PATENT DOCUMENTS

| | | | | |
|---|---|---|---|---|
| 2,975,380 A | | 3/1961 | Scharfman | |
| 3,434,147 A | | 3/1969 | Cabion et al. | |
| 4,613,836 A | * | 9/1986 | Evans | H01P 1/172 333/157 |
| 4,749,970 A | * | 6/1988 | Rammos | H01P 1/161 333/125 |
| 6,842,085 B2 | | 1/2005 | Chen et al. | |
| 7,847,652 B1 | | 12/2010 | Chen et al. | |

(Continued)

FOREIGN PATENT DOCUMENTS

| | | |
|---|---|---|
| EP | 1484785 | 12/2004 |
| JP | S56103504 | 8/1981 |
| JP | S5919401 | 1/1984 |

OTHER PUBLICATIONS

International Search Report on corresponding PCT application (PCT/US2020/045792) from International Searching Authority (EPO) dated Nov. 13, 2020.

(Continued)

*Primary Examiner* — Robert J Pascal
*Assistant Examiner* — Kimberly E Glenn
(74) *Attorney, Agent, or Firm* — Klein, O'Neill & Singh, LLP

(57) ABSTRACT

A full band waveguide orthomode transducer (OMT) includes first, second, and third waveguide sections coupled to one another, the first, second, and third waveguide sections respectively having a first port, a second port, and a third port. A first wire grid polarizer in the first waveguide section is transparent to electromagnetic signals having a first polarization and reflective of electromagnetic signals having a second polarization orthogonal to the first polarization. A second wire grid polarizer in the second waveguide section is transparent to electromagnetic signals having the second polarization and reflective of electromagnetic signals having the first polarization. The third waveguide section is configured to transmit and/or receive electromagnetic signals having the first polarization and/or the second polarization.

20 Claims, 7 Drawing Sheets

(56) References Cited

U.S. PATENT DOCUMENTS 8,816,930 B2 8/2014 Fonseca

OTHER PUBLICATIONS

Written Opinion on corresponding PCT application (PCT/US2020/045792) from International Searching Authority EPO) dated Nov. 13, 2020.

Kirilenko et al.; "Microwave-UHF Diplexer Based on a Rectangular Waveguide" Telecommunications and Radio Engineering, Scripta Technica, Inc., New York, NY, US; vol. 45, No. 9, pp. 112-115; Aug. 1, 1990; XP000269677.

* cited by examiner

FULL BAND ORTHOMODE TRANSDUCERS

CROSS-REFERENCE TO RELATED APPLICATIONS

Not Applicable

FEDERALLY FUNDED RESEARCH OR DEVELOPMENT

Not Applicable

BACKGROUND

This disclosure relates generally to the field of transducers for electromagnetic signals, particularly RF and microwave signals. More specifically, this disclosure relates to waveguide-type orthomode transducers (OMTs).

Waveguide Orthomode Transducers (OMTs) are widely used in microwave systems, particularly in radars and radiometry, where polarization diversity is required. In wireless communications, OMTs are used to receive signals having a first polarization, and to transmit signals having a second, orthogonal polarization in a single antenna. A typical OMT is a three-port device that separates and/or combines the two orthogonally-polarized signals.

The main qualities sought in an OMT are high polarization purity, high port-to-port isolation, wide frequency coverage, and compact dimensions. Compactness is an important feature, since OMTs are commonly configured as part of reflector antenna feeds. In center-fed reflector antennas, the small size of the feed is important for minimizing central blockage and associated beam distortion of the antenna. Some existing OMTs (U.S. Pat. No. 6,842,085, for example) may be relatively compact, but they are typically operable over a relatively narrow frequency range, because, due to features inherent in their design, they tend to excite higher order waveguide modes that can reduce port-to-port isolation, increase cross-polarization, and increase voltage standing wave ratio. For example, many relatively compact OMTs, such as that disclosed in the aforementioned U.S. Pat. No. 6,842,085, have a first waveguide section with a first port, a second waveguide section with a second port, and a third waveguide section with a third port, wherein the first and third ports are collinear and the second port is configured as a side port. The second (side) port thereby introduces an electromagnetic asymmetry for the signal propagating between the first and the third ports. That asymmetry may tend to excite higher order waveguide modes.

One way to suppress higher order modes in OMTs, and thus broaden frequency coverage, is to design OMTs that have a symmetric arrangement of waveguide arms, such as disclosed in U.S. Pat. No. 8,816,930. Such symmetric OMTs may, however, be too large and/or cumbersome for many applications, and they may be considered expensive and/or complicated to manufacture.

It would therefore be an advance in the relevant technology to provide a simple, compact waveguide OMT that suppresses excitation of higher order waveguide modes so as to provide high polarization purity and high port-to port isolation, while operating across a broad frequency range.

SUMMARY

This disclosure relates to a compact, full band waveguide OMT, comprising first, second, and third waveguide sections. The first waveguide section, which supports propagation of a signal having a first polarization, includes a first conductive wire grid polarization filter ("wire grid polarizer") that is transparent to the first polarization and reflective to a second polarization that is orthogonal to the first polarization. The second waveguide section, which is configured to support propagation of a signal with the second polarization, includes a second wire grid polarizer that is transparent to the second polarization and reflective to the first polarization. The first and the second waveguide sections transition to the third waveguide section that supports propagation of signals with both the first and second polarizations.

In operation, a radio-frequency signal of a first polarization entering the port of the first waveguide section propagates to the third waveguide section and is received as a signal with the first polarization at the port of the third waveguide section. The signal with the first polarization is prevented from entering the second waveguide section by the second wire grid polarizer. Reciprocally, a radio-frequency signal of a first polarization entering the port of the third waveguide section propagates to the first waveguide section and is received as a signal with the first polarization at the port of the first waveguide section. Again, the signal with the first polarization is prevented from entering the second waveguide section by the second wire grid polarizer.

A radio-frequency signal of a second polarization entering the port of the second waveguide section propagates to the third waveguide section and is received as a signal with the second polarization at the port of the third waveguide section. The signal with the second polarization is prevented from entering the first waveguide section by the first wire grid polarizer. Reciprocally, a radio-frequency signal of a second polarization entering the port of the third waveguide section propagates to the second waveguide section and is received as a signal with the second polarization at the port of the second waveguide section. Again, the signal with the second polarization is prevented from entering the first waveguide section by the first wire grid polarizer.

Among other aspects, the use of wire grid polarizers allows OMTs in accordance with this disclosure to be capable of achieving high polarization purity and high port-to-port isolation across a full waveguide frequency band. Furthermore, these advantageous characteristics may be realized in a compact, easy to manufacture device. These and other features, advantages, and attributes of OMTs in accordance with this disclosure will be more fully understood from the detailed description that follows below.

DETAILED DESCRIPTION

Figure 1:
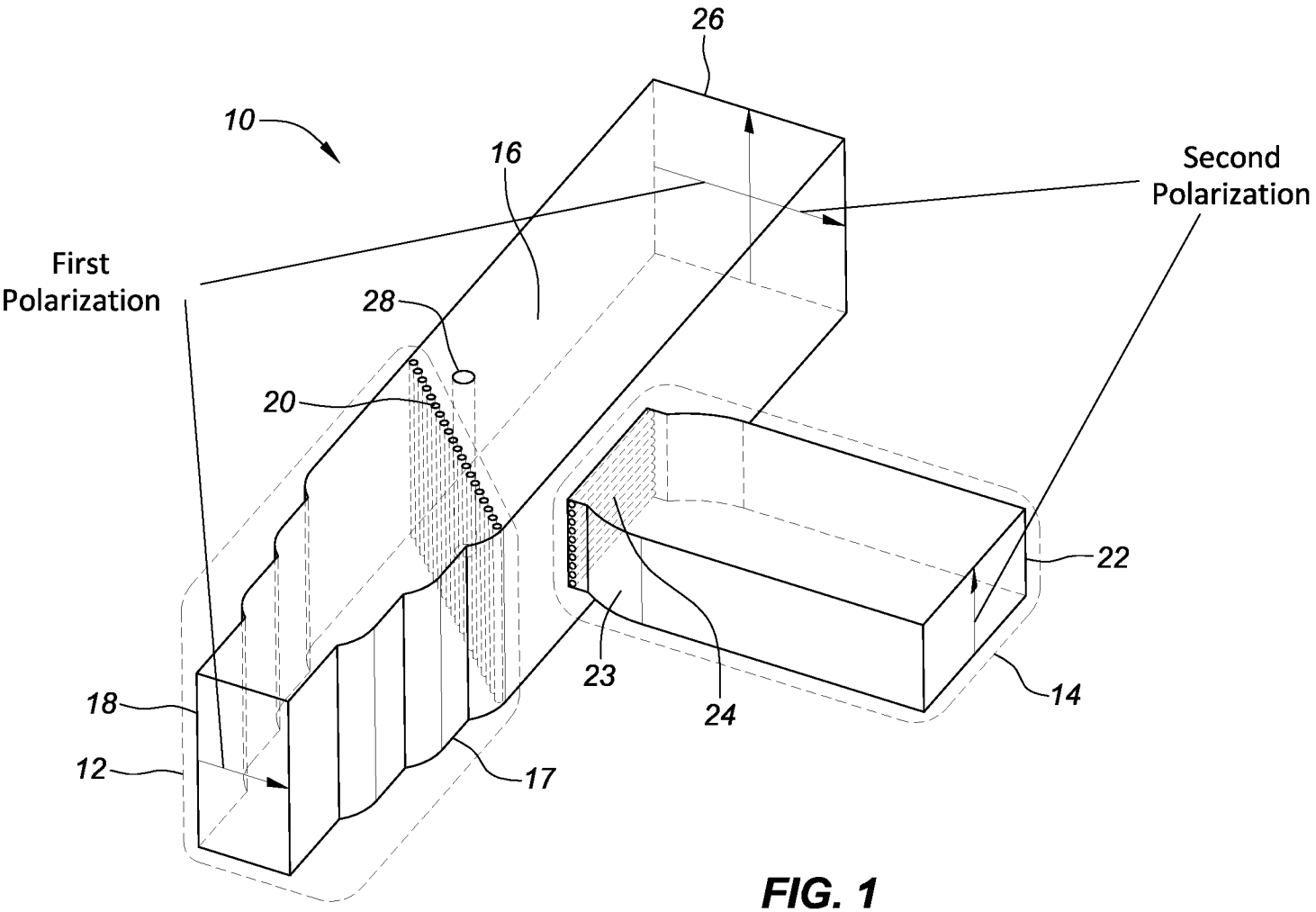
FIG. 1 is an idealized view of a full band waveguide orthomode transducer (OMT) in accordance with embodiments of the disclosure.

FIG. 1 shows a waveguide orthomode transducer (OMT) 10 in accordance with embodiments of this disclosure. The waveguide OMT 10 comprises a first waveguide section 12, a second waveguide section 14, and a third waveguide section 16 coupled to one another. In the illustrated embodiment, the first waveguide section 12 and the third waveguide section 16 are unitary and substantially collinear, while the second waveguide section 14 is fixed to the first and third waveguide sections 12, 16 so as to be substantially perpendicular thereto, although other configurations may suggest themselves depending on the particular application and/or circumstances. The waveguide sections 12, 14, 16 are shown as being substantially rectangular in cross section, although other cross-sectional shapes may be suitable or preferred in particular situations.

The frequency band of operation of a rectangular cross-section waveguide (such as the first and second waveguides 12, 14 shown in FIG. 1) is that of the dominant ("$TE_{10}$") mode of the electromagnetic wave passing through the waveguide. If a rectangular waveguide is defined as having a cross-section in which the longer dimension defines an X-axis and the shorter dimension defines a Y-axis, the direction of wave propagation would define the Z-axis. In the $TE_{10}$ mode, the electric field of an electromagnetic wave propagating through the rectangular waveguide along the Z-axis oscillates in a plane that is parallel to the Y-axis and thus orthogonal to the Z-axis, while the magnetic field has a component that oscillates in a plane that is parallel to the Z-axis. In contrast to an electromagnetic wave propagating through a rectangular waveguide, in an electromagnetic wave propagating unconstrained through free space (i.e., a "plane wave"), both the electric and magnetic fields oscillate fully in planes that are orthogonal (transverse electromagnetic, or TEM modes) to the direction of propagation (i.e., the Z-axis); that is, neither field has a component oscillating along the Z-axis. As will be seen below, OMTs in accordance with this disclosure make use of this distinguishing characteristic of a wave propagating through a rectangular waveguide.

In accordance with the US conventional nomenclature, rectangular cross section waveguides are designated as "WRx", where "x" can be a number between 3 and 2300 denoting the larger of the two cross-sectional waveguide dimensions, with the smaller dimension typically being one-half the larger dimension. Thus, for example, a WR62 waveguide would have a larger inner dimension of 0.622 inches and therefore a smaller dimension of 0.311 inches, and it would typically cover a full frequency band of 12.4-18.0 GHz. This disclosure is not, however, limited to standard waveguide sizes, nor is it limited to any particular waveguide shape.

Referring again to FIG. 1, the first waveguide section 12 may advantageously have an intermediate portion, in which the cross-sectional area is incrementally increased by increasing the shorter dimension (which may be termed the "Y-axis") of the first waveguide section 12 in discrete increments or steps 19 from a first port 18 toward an interior end, where it is joined to the second and third waveguide sections 14, 16. The stepped portion of the first waveguide section 12 is advantageous, in some embodiments, for impedance matching between the first waveguide section 12 and the third waveguide section 16, although an internal septum, iris, or diaphragm may be provided in the first waveguide section 12 at or near the first port 18 to provide impedance matching, as is known in the waveguide art. The first port 18 is rectangular in some embodiments, with the shorter dimension defining the first electromagnetic wave polarization. A first wire grid polarizer 20 is disposed at the interior end of the first waveguide section 12, at or near its juncture with the second waveguide section 14 and the third waveguide section 16.

The second waveguide section 14 extends from a second port 22 to a reduced cross section or "neck" portion 23, terminating in an interior end at which is disposed a second wire grid polarizer 24, at or near the juncture of the three waveguide section 12, 14, 16. The neck portion 23 may be advantageous, in some embodiments, for impedance matching between the second waveguide section 14 and the third waveguide section 16. In some embodiments, an iris, septum, or diaphragm may be used for this impedance matching, as is well known in the waveguide art. The second port 22 is rectangular in some embodiments, with the shorter dimension defining the second electromagnetic wave polarization that is orthogonal to the first polarization.

The third waveguide section 16 extends from a third port 26 to an interior end at which it is joined to the interior ends of the first and second waveguide sections 12, 14. The third port 26 is preferably square, with each side having a length equal to the longer dimension of each of the first port 18 and the second port 22, although other shapes (such as, for example, circular) may be suitable. The configuration (shape and dimensions) of the third port 26 are such as to permit transmission and or reception of signals having either of the first and second polarizations.

Figure 4A:
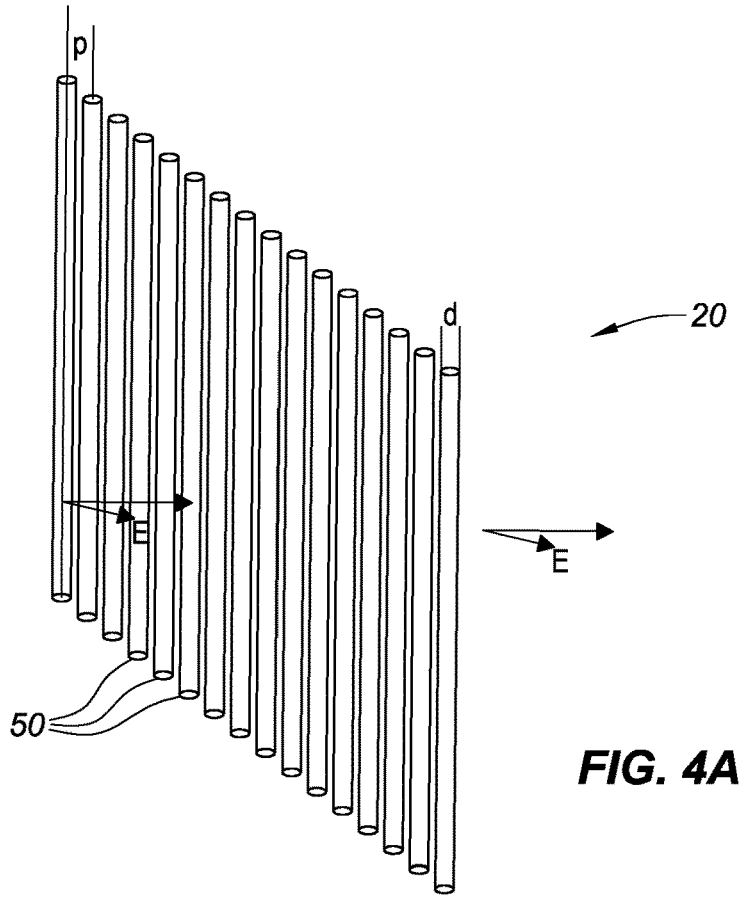
FIGS. 4A and 4B are schematic representations of the polarization filter functions of a wire grid polarizer.
Figure 4B:
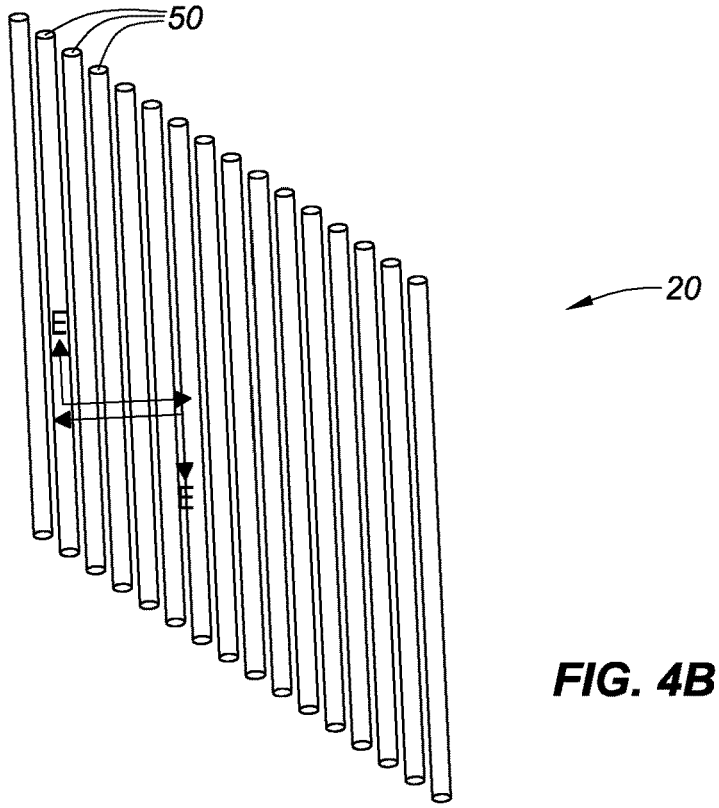

The wire grid polarizers 20, 24 are typically made of a grid of conductive wires, as is well known. While wires of circular cross section are typical, other cross-sectional shapes may be considered for use in particular applications. Simplified views of the wire grid polarizers 20, 24 used in accordance with this disclosure are shown in FIGS. 4A and 4B. The polarizers are each formed of a grid of parallel wires 50 spaced by a period P that is advantageously much smaller than the wavelength □ of the signal impinging on the polarizer (i.e., P<<□), for reasons stated below. Each individual wire 50 in the grid advantageously has a diameter d for a circular cross section, or equivalent dimension for a different cross-sectional shape. Thus configured, the grid is transparent only to incident electromagnetic waves having an electric field vector E that is perpendicular to the wires 50, as shown in FIG. 4A. Electromagnetic waves with electric field vectors that are parallel to the wires 50, by contrast, are reflected by the grid, as shown in FIG. 4B. Thus, the grids effectively polarize the incident signal by passing only waves with "perpendicular" electric field vectors ("desired polarization"), and blocking waves with "parallel" electric field vectors ("undesired polarization").

Providing a wire period P that is much less than the signal wavelength greatly inhibits wave scattering into higher order modes. Specifically, the smaller the period, the greater the reflection of the "undesired" polarization, and therefore the greater the suppression of the excitation of the higher order waveguide modes, thereby yielding high port-to-port isolation and low cross-polarization across a wide frequency range. If the period is too small, however, attenuation of the transmission of the desired polarization may be excessive. The period therefore should be large enough to allow optimum transmission of the desired polarization and to minimize the back reflection (voltage standing wave reflection or "VSWR") from the grid. Those skilled in the art will readily be able to optimize the grid period and conductor diameter to yield the desired performance for a particular application.

With wire grid polarizers 20, 24 constructed and optimized as described above, signals having a first polarization entering the first port 18 will pass readily through the first wire grid polarizer 20 to the third port 26, while being blocked from entering the second waveguide section 14 by the second wire grid polarizer 24. Similarly, signals having a second polarization orthogonal to the first polarization that enter the second port 22 will readily pass through the second wire polarizer 24 to the third port 26, while being blocked from entering the first waveguide section 12 by the first wire grid polarizer 20.

An impedance-matching element 28 may advantageously be provided in the OMT 10 at or near the juncture of the three waveguide sections 12, 14, 16, as shown in FIG. 1. For example, in the illustrated embodiment, the impedance matching element 28 may be located at or near the interior end of the third waveguide section 16, near the first wire grid polarizer 20. The use of such impedance-matching elements is well-known in the design of waveguides for RF waves. Although shown as cylindrical, the impedance-matching element 28 may be of any suitable cross-sectional shape.

The first wire grid polarizer 20 is transparent to an electromagnetic signal having a first linear polarization (e.g., along the Y-axis, as defined above), but it is reflective of radiation with a second, orthogonal linear polarization (e.g., along the X-axis, as defined above). Conversely, the second wire grid polarizer 24 is transparent to radiation having the second linear polarization, but it is reflective of a signal having the first linear polarization.

Figure 2:
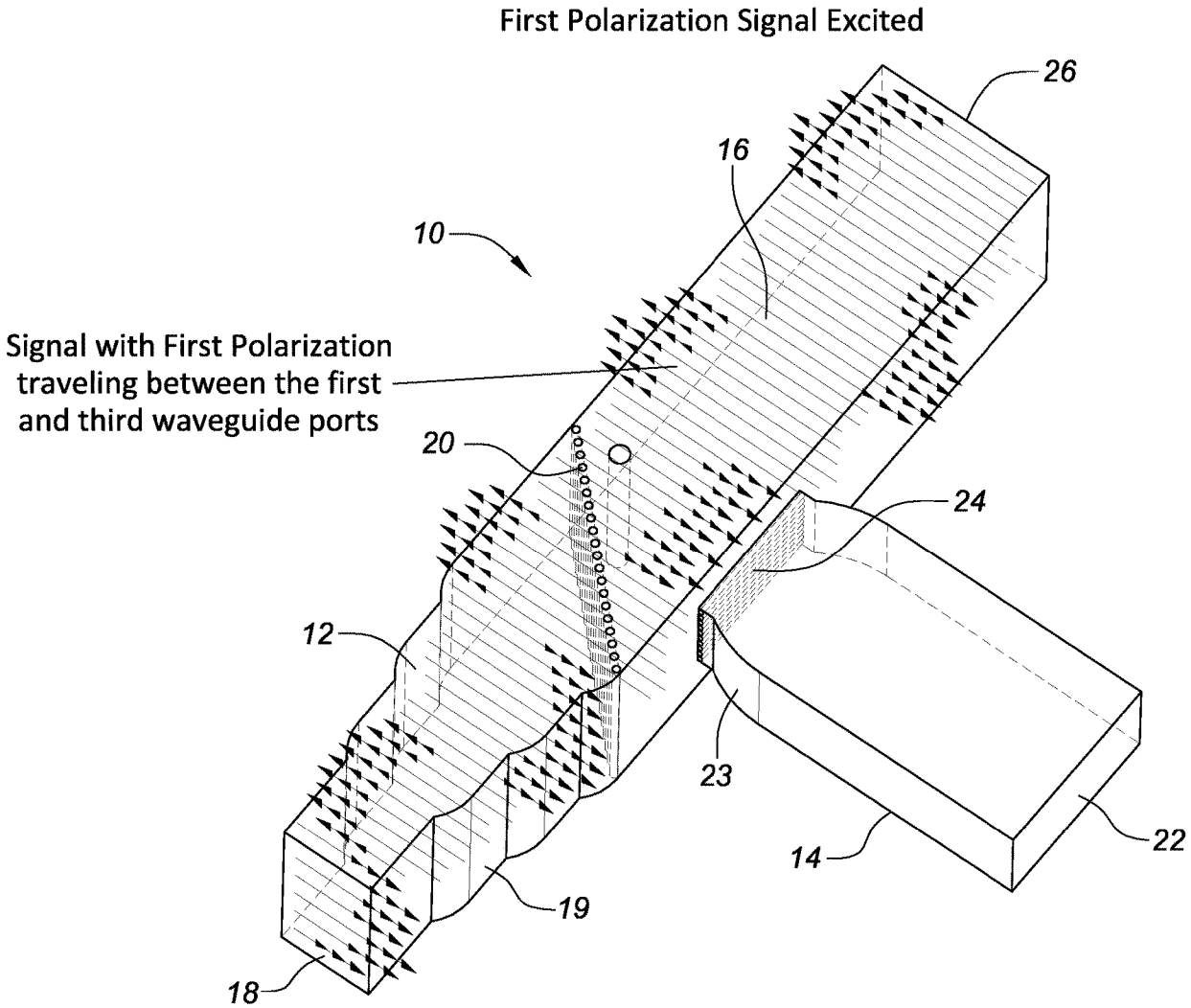
FIG. 2 is a diagrammatic view of the OMT of FIG. 1, showing the path of a signal with a first polarization between first and third waveguide ports of the OMT.
Figure 3:
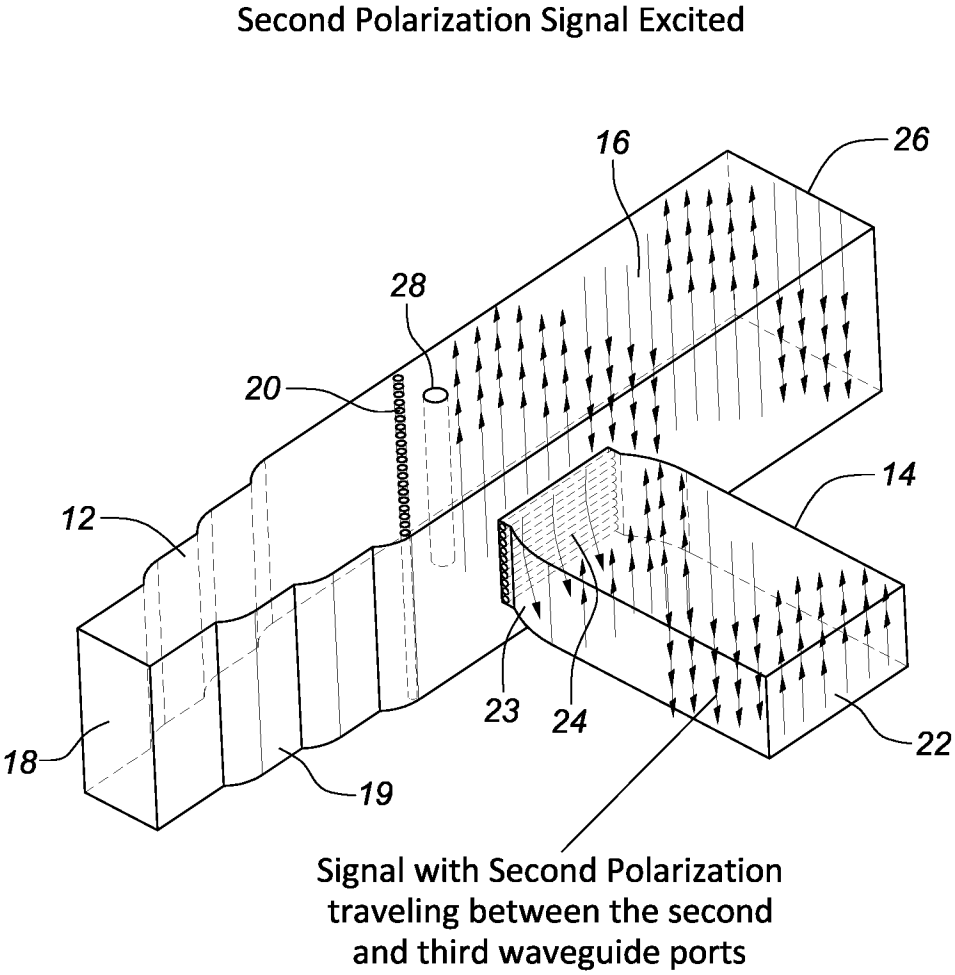
FIG. 3 is a diagrammatic view of the OMT of FIG. 1, showing the path of a signal with a second polarization between second and third waveguide ports of the OMT.

The operation of the OMT 10 is illustrated diagrammatically in FIGS. 2 and 3. As shown in FIG. 2, a radio-frequency signal of a first polarization (e.g., along the Y-axis) entering the first port 18 of the first waveguide section 12 propagates to the third waveguide section 16 and is received as a signal with the first polarization at the third port 26 of the third waveguide section 16. The signal with the first polarization is prevented from entering the second waveguide section 14 by the second wire grid polarizer 24. Reciprocally, a radio-frequency signal of a first polarization entering the third port 26 of the third waveguide section 16 propagates to the first waveguide section 12 and is received as a signal with the first polarization at the first port 18 of the first waveguide section 12. Again, the signal with the first polarization is prevented from entering the second waveguide section 14 by the second wire grid polarizer 24.

As shown in FIG. 3, a radio-frequency signal of a second polarization (e.g., along the X-axis) entering the second port 22 of the second waveguide section 14 propagates to the third waveguide section 16 and is received as a signal with the second polarization at the third port 26 of the third waveguide section 16. The signal with the second polarization is prevented from entering the first waveguide section 12 by the first wire grid polarizer 20. Reciprocally, a radio-frequency signal of a second polarization entering the third port 26 of the third waveguide section 16 propagates to the second waveguide section and is received as a signal with the second polarization at the second port 22 of the second waveguide section 14. Again, the signal with the second polarization is prevented from entering the first waveguide section 12 by the first wire grid polarizer 20.

From the foregoing, it will be appreciated that if a signal having the first polarization enters the first port 18 of the first waveguide section 12 while a signal having the second polarization enters the second port 22 of the second waveguide section, the signal that is received at the third port 26 of the third waveguide section 16 will have both the first and second polarizations. Conversely, a signal entering the third port 26 of the third waveguide section with both first and second polarizations will result in the component having the first polarization being received in the first port 18 of the first waveguide section 12, and the component having the second orthogonal polarization received at the second port 22 of the second waveguide section 14.

As shown in FIGS. 1-3, while the second wire grid polarizer 24 may be in a plane orthogonal to the axis defining the direction of propagation of the signal wave, the first wire grid polarizer 18 may advantageously be oriented at about a 45° angle with respect to the propagation axis. This orientation enhances the functioning of the first wire grid polarizer 18 as a reflective "wall" for a signal with the second polarization traveling between the second waveguide section 14 and the third waveguide section 16, which are advantageously perpendicular to each other. Accordingly, orienting the first wire grid polarizer 18 at a 45° angle reduces reflections of the signal as it makes a 90° "turn" at the junction between the second waveguide section 14 and the third waveguide section. The orientation angle of the first wire grid polarizer 18 may be different in some embodiments, depending upon the extent to which such reflections are to be reduced, if at all.

It will be appreciated that the polarization filtering provided by the wire grid polarizers 20, 24 is achieved due to the particular oscillation planes of the electric and magnetic fields of the $TE_{10}$ mode of an electromagnetic wave propagating through a rectangular cross section waveguide, as described above.

Figure 5:
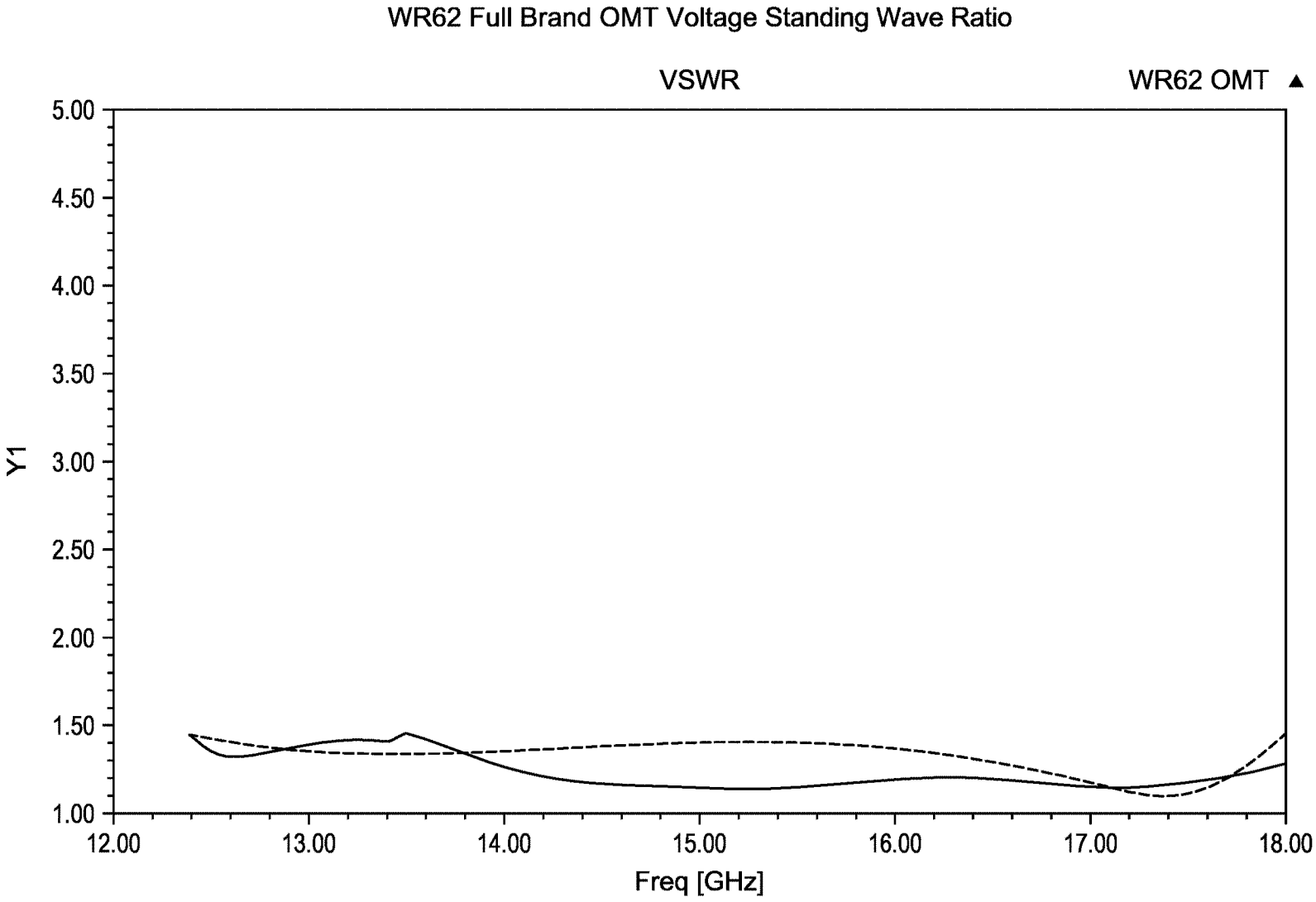
FIG. 5 is a graph showing the Voltage Standing Wave Ratio as a function of Frequency for an exemplary OMT in accordance with this disclosure.
Figure 6:
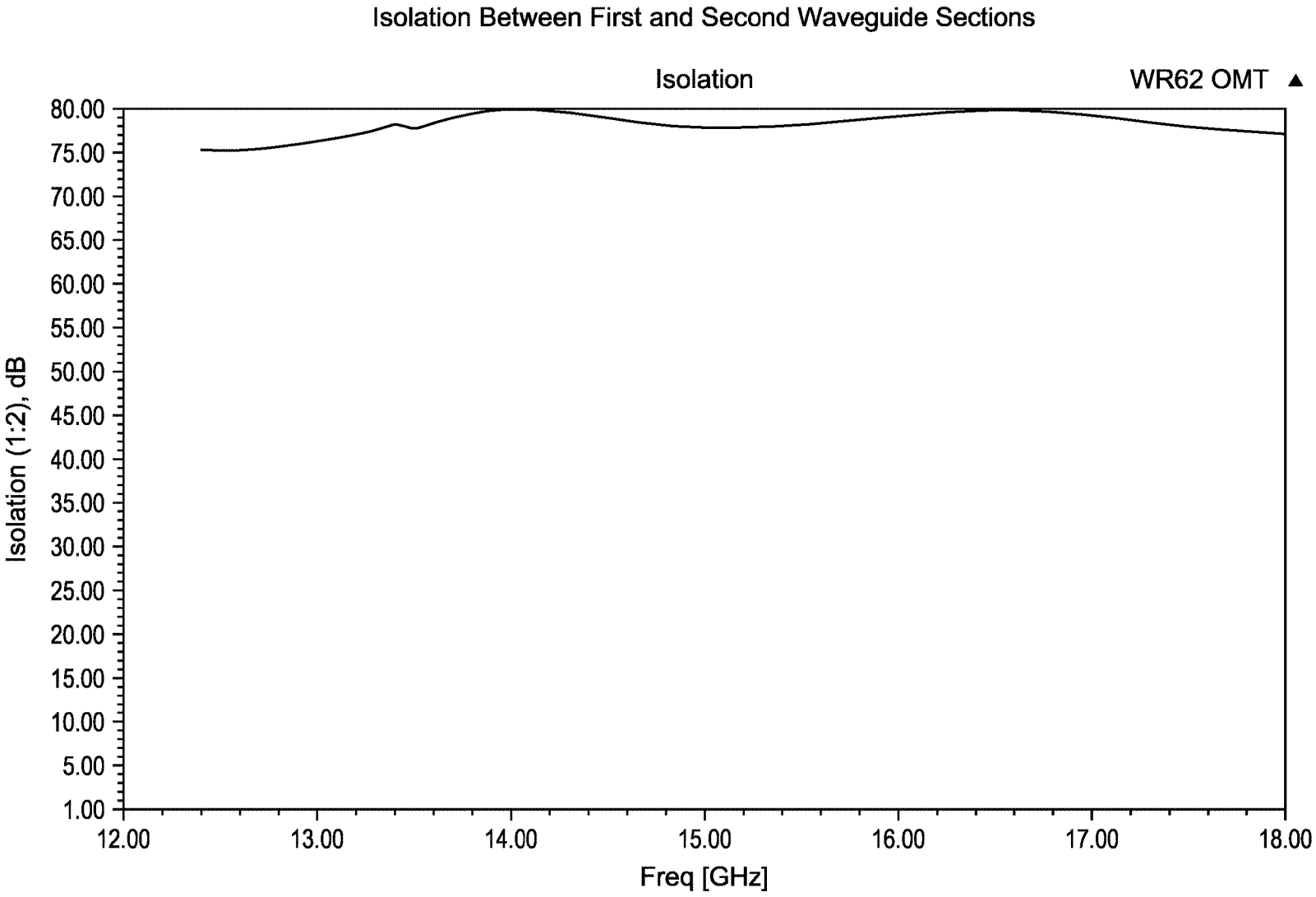
FIG. 6 is a graph showing the isolation (in dB) between the first and second waveguide sections as a function of frequency for an exemplary OMT in accordance with this disclosure.
Figure 7:
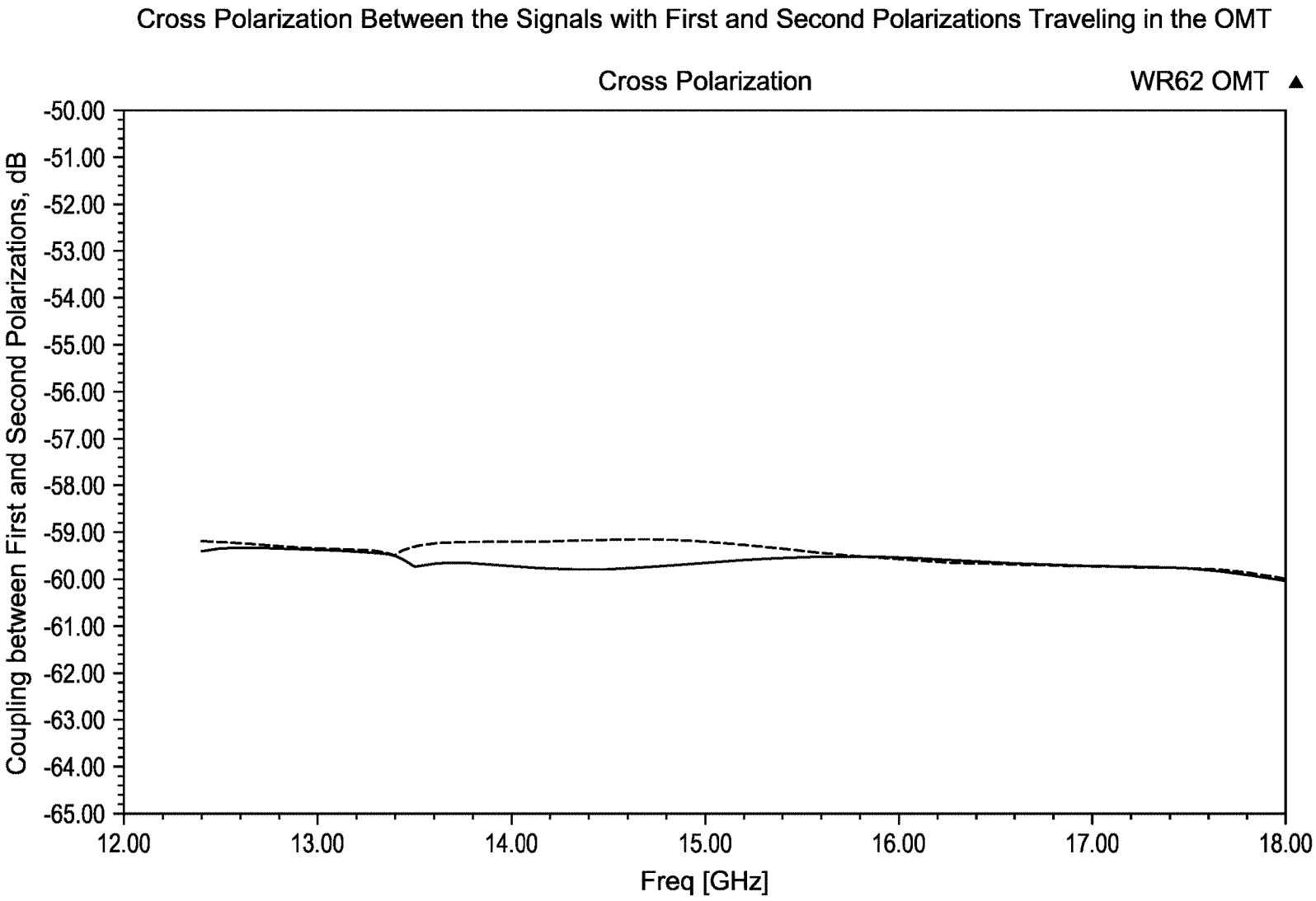
FIG. 7 is a graph showing the cross-polarization (coupling, in dB) between signals having first and second orthogonal polarizations as a function of frequency for an exemplary OMT in accordance with this disclosure.

FIGS. 5-7 illustrate full wave 3D electromagnetic simulation results for an exemplary OMT using rectangular waveguide sections, in accordance with the present disclosure. The exemplary OMT had a length of 3.1 inches (7.9 cm) from the first port 18 of the first waveguide section 12 to the third port 26 of the third waveguide section 16, and it had a second dimension (width) perpendicular to the length of 1.83 inches (4.6 cm) from the second port 22 of the second waveguide section 14 to the far (inner) wall 30 of the third waveguide section 16. At least the first and second waveguide ports 18, 22 were of a WR62 dimension. The third waveguide port 26 was a 0.622 in. by 0.622 in. (interior dimensions) square.

FIG. 5 shows two curves reflecting the voltage standing wave ratio (VSWR) as a function of frequency throughout the operational range of 12.4 to 18.0 GHz for a WR62 waveguide. Both curves show a VSWR that is essentially flat, between about 1.10 and 1.50 throughout that range. The isolation between the first and second waveguide sections 12, 14 is between 75 dB and 80 dB throughout that same frequency range, as shown in FIG. 6. Finally, FIG. 7 shows that the cross-polarization (coupling) between the first and second orthogonal polarizations propagating through the exemplary OMT is between about −59 dB and −60 dB throughout the operational frequency range, indicating a very low degree of coupling or cross-polarization between the first and second polarizations.

The results shown in FIGS. 5-7 demonstrate that OMTs in accordance with this disclosure are capable of achieving high polarization purity and high port-to-port isolation in the full waveguide band in a compact, easy to manufacture device. It is believed that similar results can be expected for OMTs in accordance with this disclosure that have rectangular waveguide sections with a wide variety of WRx values.

While preferred embodiments are disclosed herein, variations and modifications of the disclosed embodiments, and, indeed, alternative embodiments, may suggest themselves to those skilled in the pertinent arts. While some variations, modifications, and alternative embodiments have been described or suggested in this disclosure, they are not to be considered exclusive or exhaustive. Such variations, modifications, and alternatives, whether described herein or not, may, in some or all aspects, be equivalents to the subject matter of this disclosure, and should be considered to be encompassed by the claims appended hereto.

What is claimed is:

1. A full band waveguide orthomode transducer (OMT), comprising:

first, second, and third waveguide sections coupled to one another, the first, second, and third waveguide sections respectively having a first port, a second port, and a third port each of the first, second, and third waveguide sections having an open interior end;

a first wire grid polarizer in the open interior end of the first waveguide section and co-extensive therewith, the first wire grid polarizer being transparent to electromagnetic signals having a first polarization and reflective of electromagnetic signals having a second polarization orthogonal to the first polarization; and a second wire grid polarizer, in the open interior end of the second waveguide section and co-extensive therewith, the second wire grid polarizer being located at a juncture between the second waveguide section and the third waveguide section, the second wire grid polarizer being transparent to electromagnetic signals having the second polarization and reflective of electromagnetic signals having the first polarization;

wherein the third waveguide section is configured to transmit and/or receive electromagnetic signals having the first polarization and/or the second polarization.

2. The full band waveguide OMT of claim 1, wherein the first and third waveguide sections are substantially collinear, and wherein the second waveguide section is substantially perpendicular to the first and third waveguide sections.

3. The full band waveguide OMT of claim 1, wherein the first waveguide section includes a first impedance-matching structure, and wherein the second waveguide section includes a second impedance matching structure.

4. The full band waveguide OMT of claim 3, wherein the first impedance matching structure includes an intermediate portion of the first waveguide section having an incrementally-increased cross-sectional dimension.

5. The full band waveguide OMT of claim 3, wherein the second impedance matching structure includes a neck portion of the second waveguide section, the neck portion having a reduced cross-sectional dimension.

6. The full band waveguide OMT of claim 1, wherein the third waveguide section is joined to the first waveguide section at the open interior end of the third waveguide section, and wherein the full band OMT further comprises an impedance-matching element at the open interior end of the third waveguide section.

7. The full band waveguide OMT of claim 6, wherein the impedance-matching element comprises a conductive post.

8. The full band waveguide OMT of claim 1, wherein the first port is rectangular with a shorter dimension aligned with the first polarization, wherein the second port is rectangular with a shorter dimension aligned with the second polarization.

9. The full band waveguide OMT of claim 8, wherein the shorter dimension of the first port and the shorter dimension of the second port are equal, wherein the first port has a longer dimension equal to a longer dimension of the second port, and wherein the third port is square with sides equal to the longer dimension.

10. The full band waveguide OMT of claim 1, wherein the first and third waveguide sections define an axis, and wherein the first wire grid polarizer is oriented at a 45 degree angle relative to the axis.

11. A full band waveguide orthomode transducer (OMT), comprising:

a first waveguide section extending from a first waveguide port to a first open interior end;

a second waveguide section extending from a second waveguide port to a third open interior end;

a third waveguide section extending from a third waveguide port to a third open interior end joined at a first juncture to the first open interior end of the first waveguide section so as to be substantially collinear therewith;

wherein the second open interior end of the second waveguide section is joined to the third waveguide section at a second juncture so as to be substantially perpendicular to the first and third waveguide sections;

a first wire grid polarizer in the first open interior end of the first waveguide section and co-extensive therewith, the first wire grid polarizer being transparent to electromagnetic signals having a first polarization and reflective of electromagnetic signals having a second polarization orthogonal to the first polarization; and a second wire grid polarizer in the second open interior end of the second waveguide section and co-extensive therewith, the second wire grid polarizer being located at the juncture between the second waveguide section and the third waveguide section, the second wire grid polarizer being transparent to electromagnetic signals having the second polarization and reflective of electromagnetic signals having the first polarization;

wherein the third waveguide section is configured to transmit and/or receive electromagnetic signals having the first polarization and/or the second polarization.

12. The full band waveguide OMT of claim 11, wherein the first waveguide section includes a first impedance-matching structure, and wherein the second waveguide section includes a second impedance matching structure.

13. The full band waveguide OMT of claim 12, wherein the first impedance matching structure includes an intermediate portion of the first waveguide section having an incrementally-increased cross-sectional dimension.

14. The full band waveguide OMT of claim 12, wherein the second impedance matching structure includes a neck portion of the second waveguide section, the neck portion having a reduced cross-sectional dimension.

15. The full band waveguide OMT of claim 11, further comprising an impedance-matching element at the third open interior end of the third waveguide section.

16. The full band waveguide OMT of claim 15, wherein the impedance-matching element comprises a conductive post.

17. The full band waveguide OMT of claim 11, wherein the first port is rectangular with a shorter dimension aligned with the first polarization, wherein the second port is rectangular with a shorter dimension aligned with the second polarization.

18. The full band waveguide OMT of claim 17, wherein the shorter dimension of the first port and the shorter dimension of the second port are equal, wherein the first port has a longer dimension equal to a longer dimension of the second port, and wherein the third port is square with sides equal to the longer dimension.

19. The full band waveguide OMT of claim 11, wherein the first and third waveguide sections define an axis, and wherein the first wire grid polarizer is oriented at a 45 degree angle relative to the axis.

20. A method of separating or combining a first electromagnetic signal having a first polarization and a second electromagnetic signal having a second polarization, the method comprising:

providing waveguide orthomode transducer comprising a first waveguide section extending from a first waveguide port to a first open interior end, a second waveguide section extending from a second waveguide port to a second open interior end, and a third waveguide section extending from a third waveguide port to a third open interior end joined at a first juncture to the first open interior end of the first waveguide section so as to be substantially collinear therewith, wherein the second open interior end of the second waveguide section is joined to the third waveguide section at a second juncture so as to be substantially perpendicular to the first and third waveguide sections;

providing (1) a first wire grid polarizer in the first open interior end of the first waveguide section so as to be co-extensive therewith, the first wire grid polarizer being transparent to the first electromagnetic signal and reflective of the second electromagnetic signal, and (2) a second wire grid polarizer in the second open interior end of the second waveguide section so as to be co-extensive therewith, the second wire grid polarizer being located at the second juncture, the second wire grid polarizer being transparent to the second electromagnetic signal and reflective of the second electromagnetic signal; and transmitting and/or receiving in the third waveguide section at least one of the first and second electromagnetic signals.

* * * * *